US010639778B2

(12) United States Patent
Wang et al.

(10) Patent No.: US 10,639,778 B2
(45) Date of Patent: May 5, 2020

(54) MAGAZINE ASSEMBLY AND STAPLER INCLUDING THE SAME

(71) Applicant: APEX MFG. CO., LTD., Taichung (TW)

(72) Inventors: Jing- Li Wang, Taichung (TW); Py-Yi Chang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 259 days.

(21) Appl. No.: 15/701,996

(22) Filed: Sep. 12, 2017

(65) Prior Publication Data

US 2019/0077001 A1 Mar. 14, 2019

(51) Int. Cl.

| | |
|---|---|
| ***B25C 5/16*** | (2006.01) |
| ***B25C 5/02*** | (2006.01) |
| ***B25C 5/11*** | (2006.01) |

(52) U.S. Cl.

CPC ..... *B25C 5/1617* (2013.01); *B25C 5/0285* (2013.01); *B25C 5/11* (2013.01)

(58) Field of Classification Search

CPC ..... B25C 5/0285; B25C 5/16; B25C 5/161; B25C 5/1648; B25C 5/1651; B25C 5/1617; B25C 5/1624; B25C 5/1655; B25C 5/1606

USPC ..... 227/109, 120

See application file for complete search history.

(56) References Cited

U.S. PATENT DOCUMENTS

| | | | | |
|---|---|---|---|---|
| 5,857,608 | A * | 1/1999 | Liau | B25C 5/025 227/113 |
| 6,367,676 | B1 * | 4/2002 | Opland | B25C 5/11 227/123 |
| 2003/0201299 | A1 * | 10/2003 | Chen | B25C 1/005 227/109 |
| 2006/0108390 | A1 * | 5/2006 | Schnell | B25C 1/005 227/120 |
| 2008/0296340 | A1 * | 12/2008 | Wang | B25C 5/1651 227/109 |
| 2009/0114698 | A1 * | 5/2009 | Marks | B25C 5/0292 227/132 |
| 2010/0230463 | A1 * | 9/2010 | Yang | B25C 1/005 227/109 |
| 2011/0180583 | A1 * | 7/2011 | Wang | B25C 5/1644 227/109 |
| 2013/0221056 | A1 * | 8/2013 | Chen | B25C 5/162 227/120 |
| 2015/0352703 | A1 * | 12/2015 | Wu | B25C 5/06 227/109 |

(Continued)

*Primary Examiner* — Hemant Desai
*Assistant Examiner* — Jacob A Smith
(74) *Attorney, Agent, or Firm* — Muncy, Geissler, Olds & Lowe, PC

(57) ABSTRACT

A magazine assembly and a stapler including the same are provided. The magazine assembly includes a main body and a staple-pushing mechanism. The main body has a seat body and at least one rail, the seat body has a first end portion and a second end portion, a connection of the first and second end portions is defined as a moving path, and the at least one rail is disposed on the seat body. The staple-pushing mechanism is arranged on the main body, the staple-pushing mechanism includes a staple-pushing member and a constant force spring, and the staple-pushing member is driven to move toward the first end portion via the constant force spring.

9 Claims, 9 Drawing Sheets

(56) References Cited

U.S. PATENT DOCUMENTS

| | | | | |
|---|---|---|---|---|
| 2016/0001431 | A1* | 1/2016 | Yang | B25C 1/005 227/109 |
| 2017/0203426 | A1* | 7/2017 | Yu | B25C 5/1617 |
| 2017/0252914 | A1* | 9/2017 | Huang | B25C 5/1617 |

* cited by examiner

MAGAZINE ASSEMBLY AND STAPLER INCLUDING THE SAME

BACKGROUND OF THE INVENTION

Field of the Invention

The present invention relates to a magazine assembly and a stapler including the same.

Description of the Prior Art

Staplers are widely used in the carpentry industry or renovation industry, and workers use the staplers to fire staples to connect different workpieces (such as wood block) together. It is understandable that the workers need to cut or transport the workpieces during the whole working process, so it is labor-consuming for the workers. Therefore, in order to save labor and increase assembling efficiency, most stapler manufacturers focus on designing a labor-saving mechanism of the stapler so that the workers can fire the staple with less strength.

However, the manufacturers neglect that other component structures may influence the stability of the staple discharging process and may further influence the product quality after being assembled. For example, in a conventional stapler, a cooperation mechanism or actuating mechanism of a rail and a staple of a magazine assembly may influence the performance stability of the stapler and need to be improved.

The present invention has arisen to mitigate and/or obviate the afore-described disadvantages.

SUMMARY OF THE INVENTION

The major object of the present invention is to provide a magazine assembly and a stapler including the same, which actuate a staple-pushing member to move via a constant force spring to produce a stable pushing force to push a staple unit, and the staple is in a stable state when it is to be fired so as to elevate staple discharging quality and stapling precision.

To achieve the above and other objects, a magazine assembly is provided for being disposed in a stapler, and the magazine assembly includes a main body and a staple-pushing mechanism. The main body has a seat body and at least one rail, the seat body has a first end portion and a second end portion, the first end portion is closer to a striking plate of the stapler than the second end portion, the striking plate is used to strike a staple of a staple unit, a connection of the first and second end portions is defined as a moving path, the at least one rail is disposed on the seat body for the staple unit to abut thereagainst and move along the moving path. The staple-pushing mechanism has a staple-pushing member, at least one chute, a constant force spring which is normally rolled up, a base portion and a connecting portion, the staple-pushing member is movably arranged on the main body and movable along the moving path, the staple-pushing member is for abutting against the staple unit, the at least one chute is formed on the main body and extends along the moving path, the constant force spring is able to be optionally rolled up with the base portion as an axle, the base portion is connected to the staple-pushing member, the connecting portion is connected to the staple-pushing member and slidably arranged in the at least one chute. A free end of the constant force spring is positioned on the first end portion and drives the staple-pushing member to move toward the first end portion normally.

To achieve the above and other objects, a stapler is further provided, including the above-mentioned magazine assembly and further including a machine body assembly. The machine body assembly includes a pressing member, a shell body and a striking plate, the shell body has a magazine area which receives the magazine assembly, the magazine assembly and the shell body define a staple outlet therebetween, the staple outlet is for corresponding to a part of the staple of the staple unit, the pressing member and the striking plate are linked up, when the pressing member is operated from outside and moves relative to the shell body, the striking plate is driven to move toward an opening of the staple outlet and further strike a part of the staple of the staple unit.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
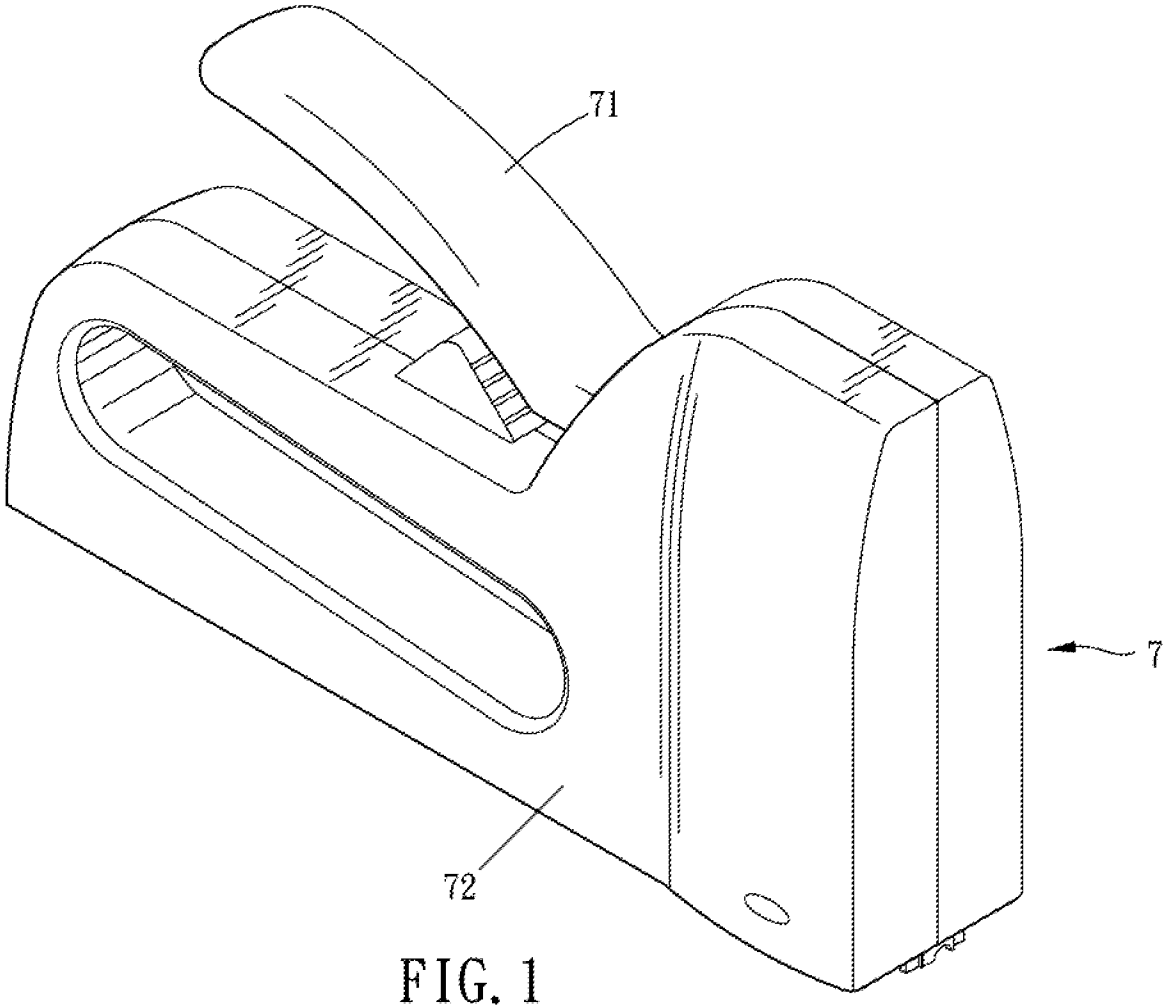
FIG. 1 is a stereogram of an embodiment of the present invention.
Figure 2:
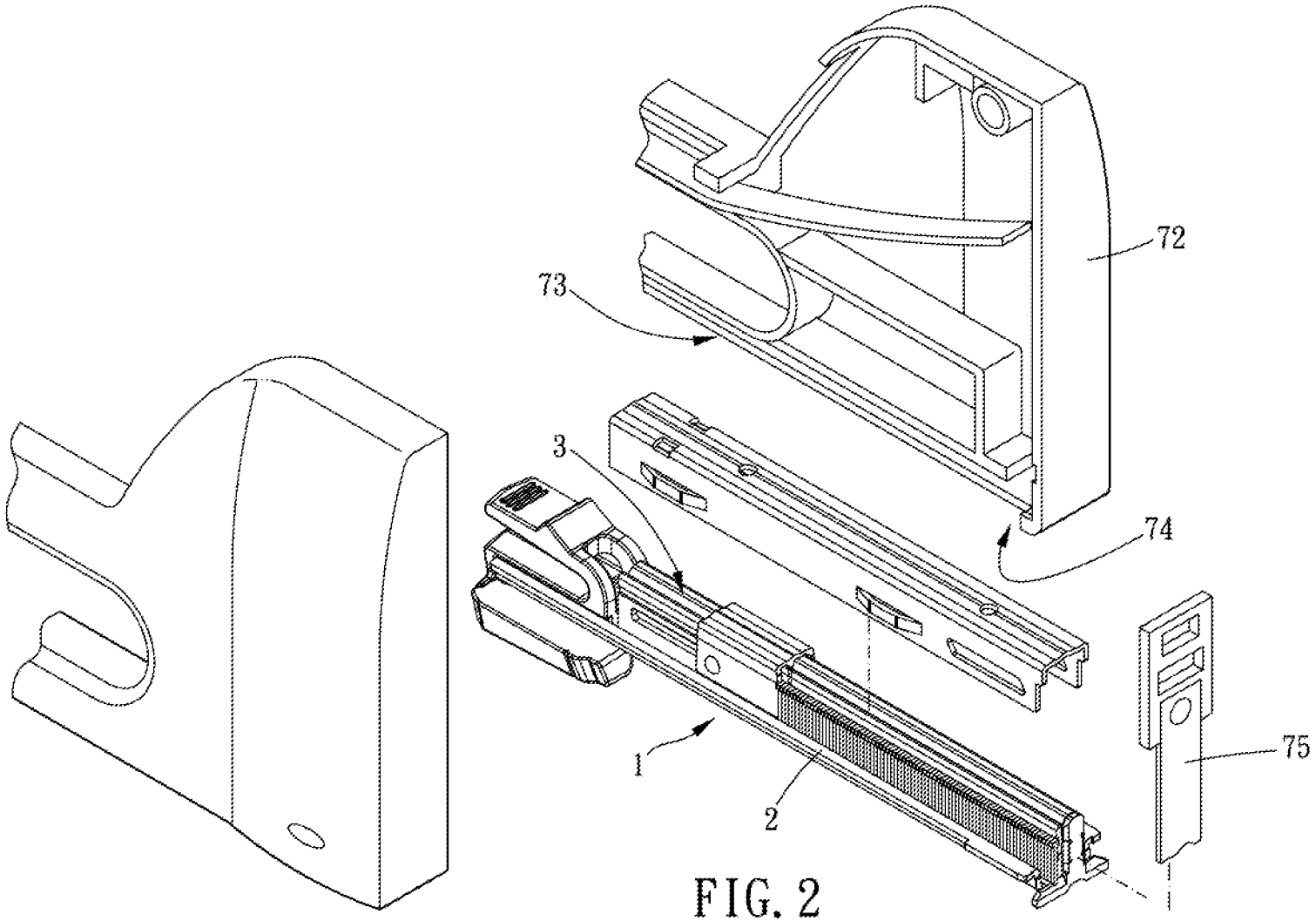
FIG. 2 is a breakdown view of FIG. 1.
Figure 3:
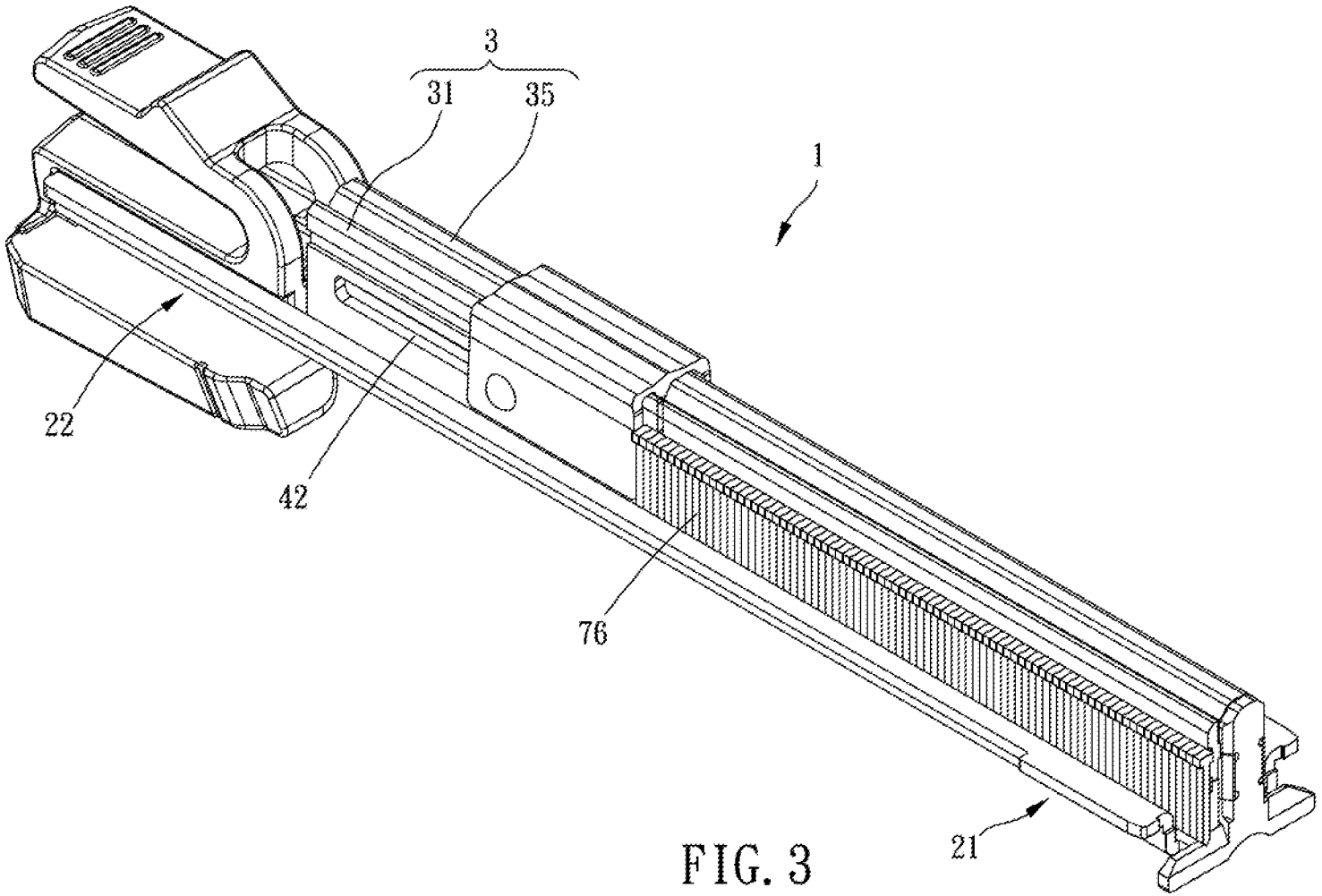
FIGS. 3 and 4 are stereograms of a magazine assembly of the embodiment of the present invention.
Figures 4, 5:
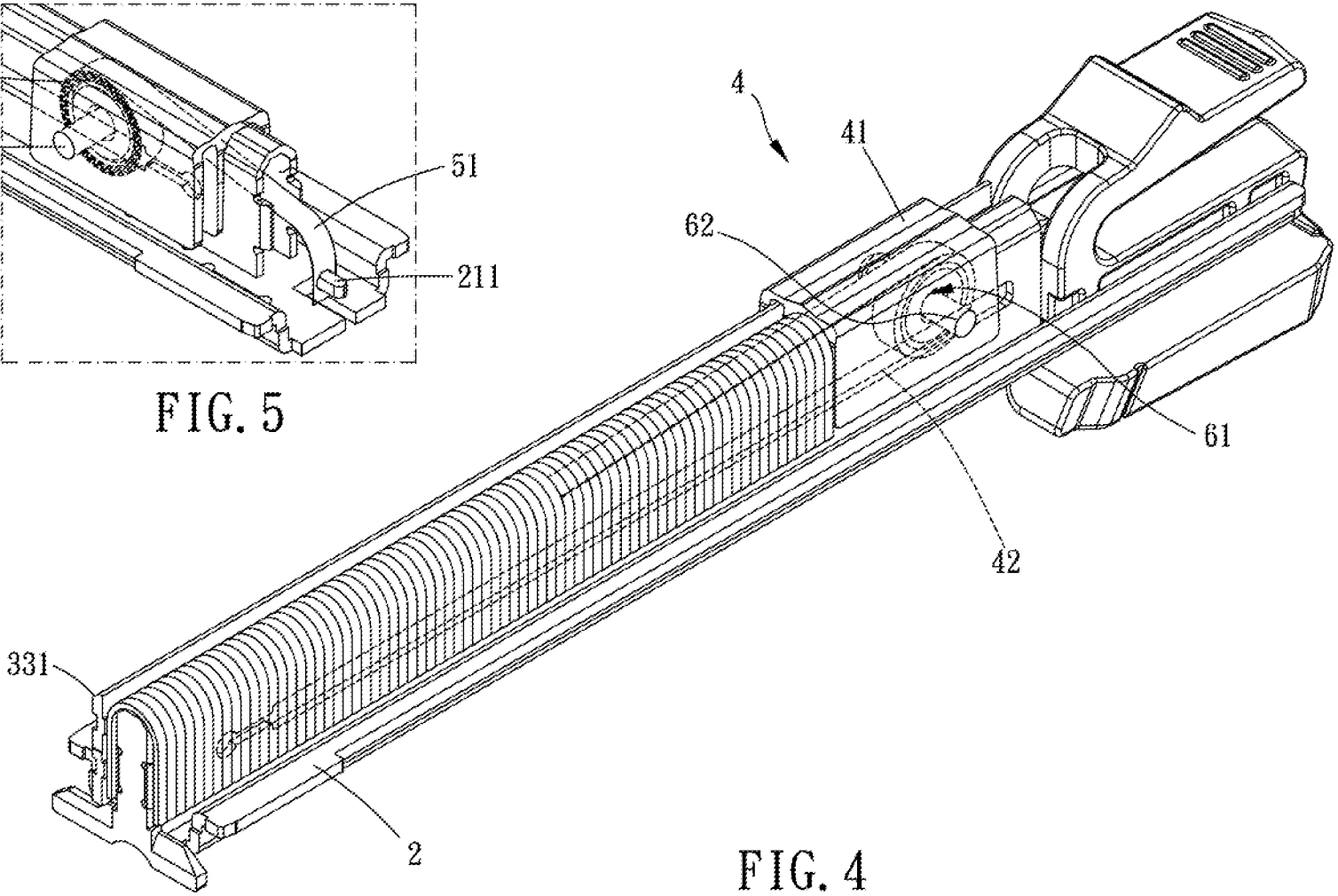
FIG. 5 is a partial breakdown view of the embodiment of the present invention.

The present invention will be clearer from the following description when viewed together with the accompanying drawings, which show, for purpose of illustrations only, the preferred embodiment in accordance with the present invention.

Please refer to FIGS. 1 to 11 for an embodiment of a magazine assembly and a stapler 7 including the same of the present invention.

The magazine assembly is for being disposed in the stapler 7, and the magazine assembly includes a main body 1 and a staple-pushing mechanism 4. The main body 1 has a seat body 2 and at least one rail 3, the seat body 2 has a first end portion 21 and a second end portion 22, the first end portion 21 is closer to a striking plate 75 of the stapler 7 than the second end portion 22, the striking plate 75 is used to strike a staple of a staple unit 76, a connection of the first and second end portions 21, 22 is defined as a moving path 81, the at least one rail 3 is disposed on the seat body 2 for the staple unit 76 to abut thereagainst and move along the moving path 81. The staple-pushing mechanism 4 has a staple-pushing member 41, at least one chute 42, a constant force spring 5 which is normally rolled up, a base portion 61 and a connecting portion 62, the staple-pushing member 41 is movably arranged on the main body 1 and movable along the moving path 81, the staple-pushing member 41 is for abutting against the staple unit 76, the at least one chute 42 is formed on the main body 1 and extends along the moving path 81, the constant force spring 5 is able to be optionally rolled up with the base portion 61 as an axle, the base portion 61 is connected to the staple-pushing member 41, the connecting portion 62 is connected to the staple-pushing member 41 and slidably arranged in the at least one chute 42.

A free end 51 of the constant force spring 5 is positioned on the first end portion 21 and drives the staple-pushing member 41 to move toward the first end portion 21 normally. In other words, the constant force spring 5 moves with the staple-pushing member 41 toward the first end portion 21, and the staple-pushing member 41 can be driven by the constant force spring 5 producing constant torque so that the staple-pushing member 41 can push the staple unit 76 to move toward the first end portion 21 more stably. Therefore, the staple unit 76 can be ensured to stay in a stable state to be fired and to have a preferable staple discharging quality and stapling precision. In addition, constant force spring has a smaller volume and greater output force, so the constant force spring 5 does not occupy much space and allows a structure of the magazine assembly to be more compact.

Figure 6:
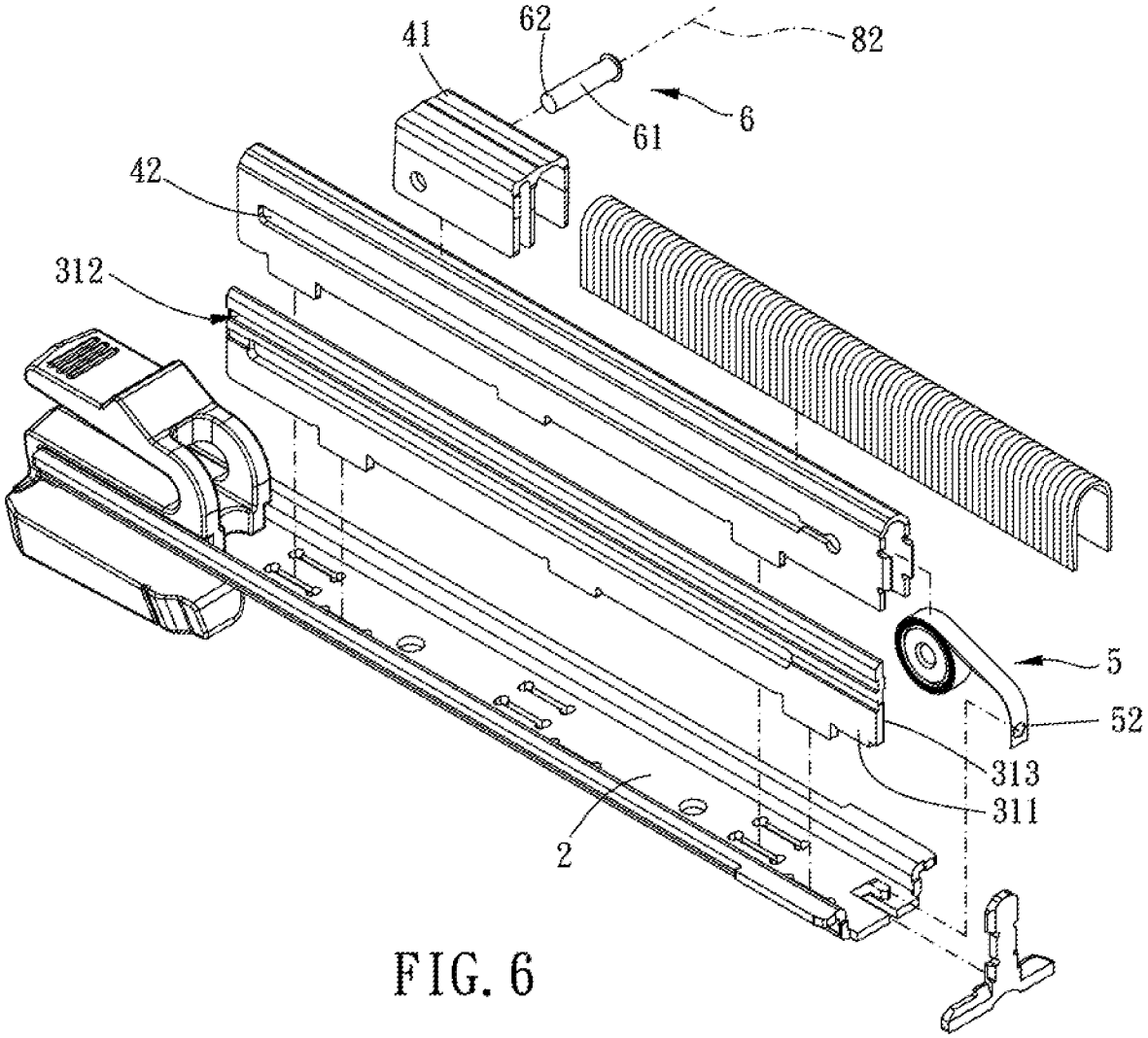
FIG. 6 is a breakdown view of FIG. 3.

Specifically, the at least one chute 42 is formed on the at least one rail 3, a shaft member 6 is disposed through the constant force spring 5 along an assembling direction 82, the shaft member 6 is connected to the staple-pushing member 41 to make the staple-pushing member 41 and the constant force spring 5 be in a co-movement relation. The assembling direction 82 is defined to be perpendicular to the moving path 81, a part of the shaft member 6 which overlaps with the constant force spring 5 is defined as the base portion 61, a part of the shaft member 6 which protrudes beyond the constant force spring 5 is the connecting portion 62, and the shaft member 6 is connected to the connecting portion 62 (as shown in FIG. 6). Of course, in other embodiments, the shaft member 6 and the connecting portion 62 are two independent components. More specifically, the at least one chute 42 penetrates the at least one rail 3, the shaft member 6 is disposed through the at least one chute 42 and the constant force spring 5 and further positioned on the staple-pushing member 41, and the staple-pushing member 41 is arranged on the at least one rail 3.

In this embodiment, a number of the at least one rail 3 is two, the two rails 3 are respectively a first rail 31 and a second rail 35 which are spacingly arranged, the first and second rails 31, 35 can be adapted to different modes of the staple unit 76, the first rail 31 is for a T-shaped staple of the staple unit 76 to abut thereagainst, the second rail 35 is for a U-shaped staple of the staple unit 76 to abut thereagainst. Of course, in other embodiments, there may be just one rail. In addition, a number of the at least one chute 42 is three, the three chutes 42 penetrate the first and second rails 31, 35 on a same plane along the assembling direction 82, and the shaft member 6 is disposed through the three chutes 42 with two ends of the shaft member 6 being respectively positioned on the staple-pushing member 41.

Specifically, the first rail 31 is substantially slab-shaped, the second rail 35 is substantially U-shaped and defines a receiving space 36 with the seat body 2, as viewed along the moving path 81, the staple-pushing member 41 is substantially E-shaped and sandwiched by the first and second rails 31, 35, and the constant force spring 5 is received in the receiving space 36. When there is an unexpected impact, the constant force spring 5 will not fall off from the main body 1 easily. In other words, the second rail 35 has an extra function of stabilizing the constant force spring 5. Preferably, a width of the constant force spring 5 is substantially equal to a distance between two inner walls of the second rail 35 so as to decrease a gap between the constant force spring 5 and the two inner walls of the second rail 35 on the assembling direction 82 and to make the constant force spring 5 more stable.

Figure 7:
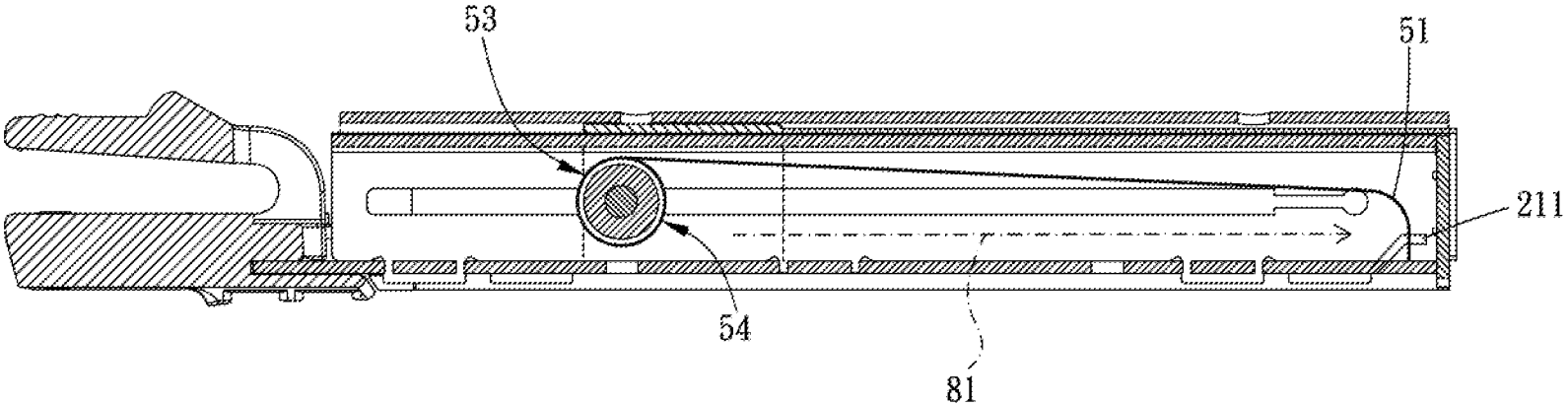
FIGS. 7 and 8 are cross-sectional side views showing the embodiment of the present invention in operation.
Figure 8:
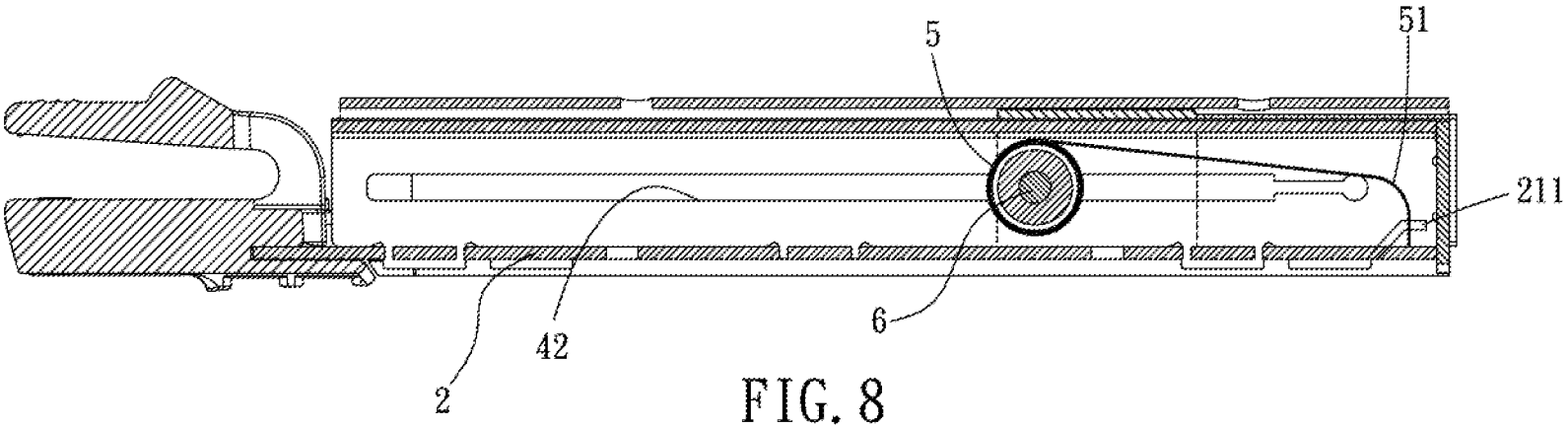

More specifically, the first end portion 21 has a hook portion 211, the constant force spring 5 has a through hole 52 on the free end 51, and the hook portion 211 is disposed through the through hole 52 to make the free end 51 positioned on the seat body 2. As viewed along the assembling direction 82, a first side portion 53 of the constant force spring 5 is remote from the seat body 2, a second side portion 54 of the constant force spring 5 is close to the seat body 2, the free end 51 is connected to and positioned on the first end portion 21 from the first side portion 53 toward the second side portion 54 (as shown in FIGS. 7 and 8).

Figure 9:
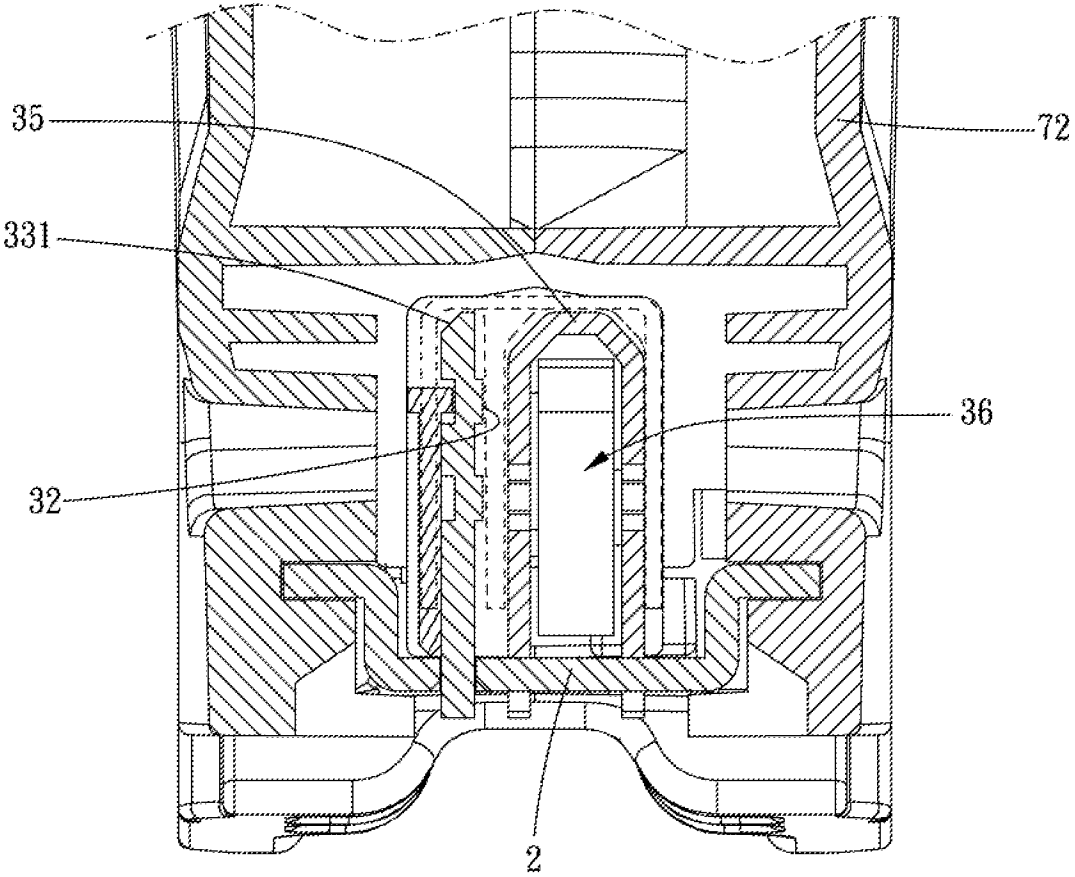
FIGS. 9 to 11 are cross-sectional views of the embodiment of the present invention in different states.
Figure 10:
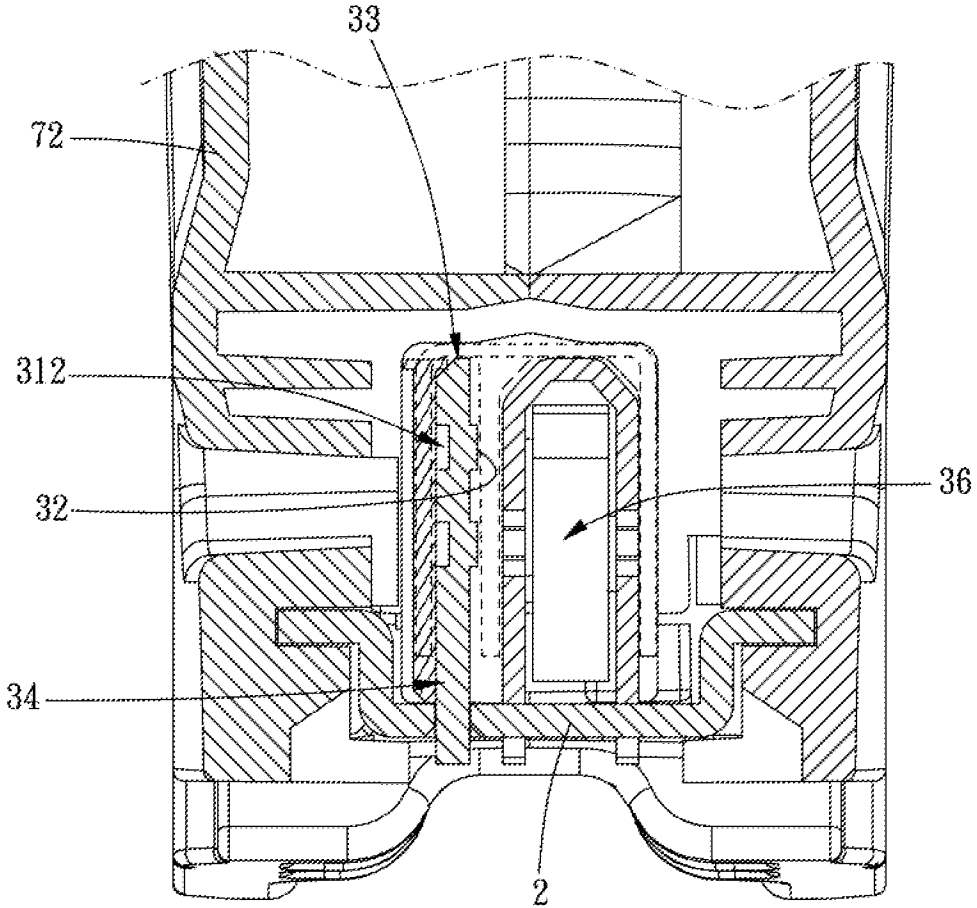

Preferably, at least one guiding portion 312 which extends along the moving path 81 is recessed on a first side wall 311 of the first rail 31, and each said guiding portion 312 is for a head portion of the T-shaped staple of the staple unit 76 to be slidably engaged and positioned along the moving path 81. Therefore, when the first rail 31 has a plurality of the guiding portions 312, a user can put the T-shaped staple that s/he wants to use into the guiding portion 312 which has a height corresponds to the length of the T-shaped staple so that a leg of the T-shaped staple can firmly contact the seat body 2 (as shown in FIGS. 9 and 10) to further elevate staple discharging quality and stapling precision. In addition, when the T-shaped staple is struck by the striking plate, the T-shaped staple moves backward due to counter force, the head portion of the T-shaped staple is restricted in an interior of the guiding portion 312, the T-shaped staple will not move backward greatly (or even not move backward at all). Hence, the T-shaped staple can stay in a preferable state to be fired, and a structure of the T-shaped staple which has not been used can be kept integral.

Figure 11:
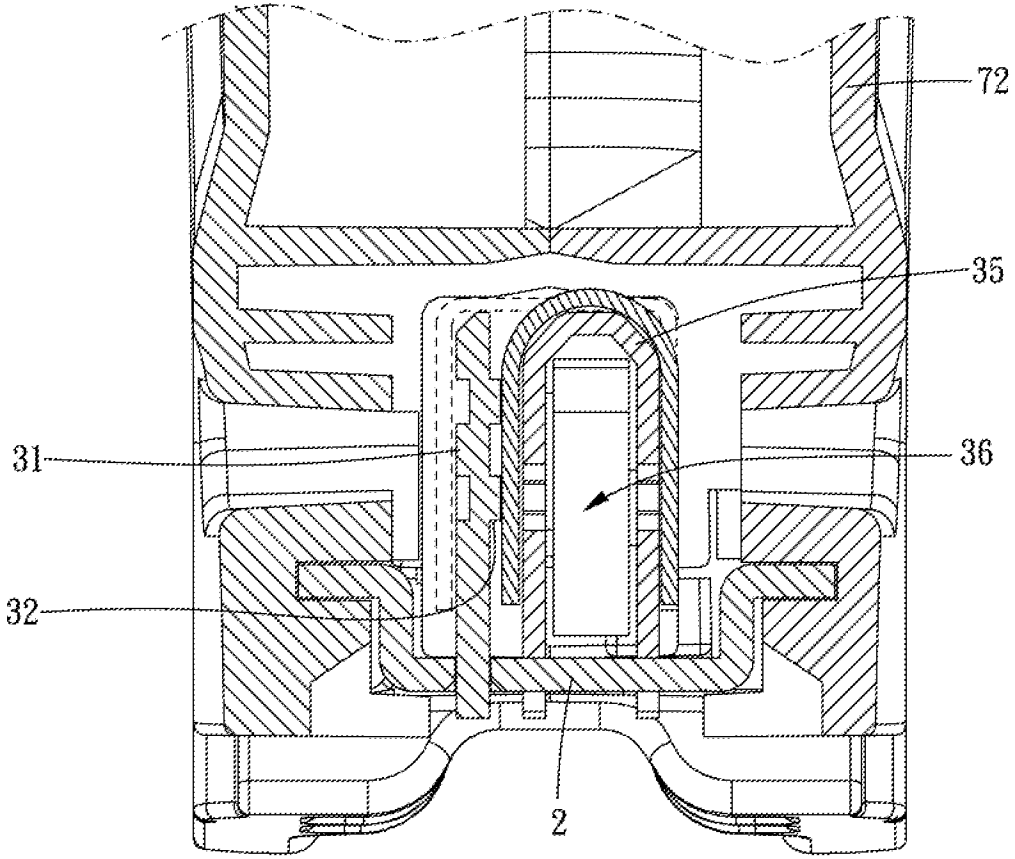

More preferably, the first rail 31 further has a second side wall 313 facing the second rail 35, the second side wall 313 has at least one rib portion 32 which extends along the moving path 81, the at least one rib portion 32 respectively corresponds to the at least one guiding portion 312, the at least one rib portion 32 protrudes toward the second rail 35, and the at least one rib portion 32 is for abutting laterally against the U-shaped staple of the staple unit 76 to enhance the stability (as shown in FIG. 11).

Even more preferably, the first rail 31 further has a top portion 33 and a bottom portion 34 which are connected to the first and second side walls 311, 313, the bottom portion 34 is connected to the seat body 2, the top portion 33 has an inclined surface 331, the inclined surface 331 tilts from the second side wall 313 toward the first side wall 311 and the seat body 2, and when the T-shaped staple is longer and unable to be put into the guiding portion 312, the inclined face 331 is for the head portion of the T-shaped staple to optionally abut thereagainst. The design of continuous inclination is workable for the T-shaped staples in different lengths, and the leg of the T-shaped staple can firmly abut against the seat body 2. In this embodiment, a number of the at least one guiding portion 312 is two, and a distance between the two guiding portions 312 is substantially equally to a shortest distance between the inclined face 331 to one said guiding portion 312 which is the closest to the inclined face 331.

A stapler 7 is further provided, including the above-mentioned magazine assembly and further including a machine body assembly. The machine body assembly includes a pressing member 71, a shell body 72 and the striking plate 75, the shell body 72 has a magazine area 73 which receives the magazine assembly, the magazine assembly and the shell body 72 define a staple outlet 74 therebetween, the staple outlet 74 is for corresponding to a part of the staple of the staple unit 76, the pressing member 71 and the striking plate 75 are linked up, when the pressing member 71 is operated from outside and moves relative to the shell body 72, the striking plate 75 is driven to move toward an opening of the staple outlet 74 and further strike a part of the staple of the staple unit 76.

It is to be noted that this embodiment takes a manual stapler as an example, the pressing member 71 and the striking plate 75 are connected via an elastic board cooperating with a linkage mechanism, and the striking plate 75 is actuated to fire the staple by an elasticity produced by the elastic board which is bent and deformed. However, the type of the stapler 7 is not limited thereto, and in other embodiments, there may be a pneumatic stapler or an electronic stapler.

Given the above, the magazine assembly and the stapler including the same actuates the staple-pushing member to move via the constant force spring so that the staple-pushing member stably pushes the staple unit, and the staple is in a stable state to be fired. In addition, the first and second rails can be adapt to different types of stapes, and the first rail has the guiding portion which can cooperate with and position the T-shaped staple in different lengths, so the stapler is more convenient and stable for the user.

While we have shown and described various embodiments in accordance with the present invention, it should be clear to those skilled in the art that further embodiments may be made without departing from the scope of the present invention.

What is claimed is:

1. A magazine assembly, for being disposed in a stapler, the magazine assembly including:

a main body, having a seat body and at least one rail, the seat body having a first end portion and a second end portion, the first end portion being closer to a striking plate of the stapler than the second end portion, the striking plate being used to strike a staple of a staple unit, a connection of the first and second end portions being defined as a moving path, the at least one rail being disposed on the seat body for the staple unit to abut thereagainst and move along the moving path;

a staple-pushing mechanism, having a staple-pushing member, at least one chute, a constant force spring which is rolled up and a connecting portion, the staple-pushing member being movably arranged on the main body and movable along the moving path, the staple-pushing member for abutting against the staple unit, the at least one chute being formed on the main body and extending along the moving path, the connecting portion being connected to the staple-pushing member and slidably arranged in the at least one chute, the constant force spring is rollably positioned in the staple-pushing member;

wherein a free end of the constant force spring is positioned on the first end portion and drives the staple-pushing member to move toward the first end portion normally;

wherein the staple-pushing member is wider than the at least one chute in a direction lateral to the moving path and located entirely outside the at least one chute, the at least one chute is disposed through the at least one rail, and the connecting portion is disposed through the at least one rail and contactable with the at least one rail within the at least one chute;

the shaft member is disposed through the at least one chute and the constant force spring and further positioned on the staple-pushing member; the staple-pushing member is arranged on the at least one rail, a number of the at least one rail is two, the two rails are respectively a first rail and a second rail which are spacingly arranged, the first rail is for a T-shaped staple of the staple unit to abut thereagainst, the second rail is for a U- shaped staple of the staple unit to abut thereagainst, a number of the at least one chute is three, the three chutes penetrate the first and second rails on a same plane along the assembling direction, and the shaft member is disposed through the three chutes with two ends of the shaft member being respectively positioned on the staple-pushing member.

2. The magazine assembly of claim 1, wherein the staple-pushing mechanism further includes a base portion, the base portion is connected to the staple-pushing member, and the constant force spring is able to be optionally rolled up with the base portion as an axle.

3. The magazine assembly of claim 2, wherein a shaft member is disposed through the constant force spring along an assembling direction, the shaft member is connected to the staple-pushing member to make the staple-pushing member and the constant force spring be in a co-movement relation; wherein the assembling direction is defined to be perpendicular to the moving path, a part of the shaft member which overlaps with the constant force spring is defined as the base portion, a part of the shaft member which protrudes beyond the constant force spring is the connecting portion, and the shaft member is connected to the connecting portion.

4. The magazine assembly of claim 1, wherein the first rail is substantially slab-shaped, the second rail is substantially U-shaped and defines a receiving space with the seat body, and the constant force spring is received in the receiving space.

5. The magazine assembly of claim 1, wherein at least one guiding portion which extends along the moving path is recessed on a first side wall of the first rail, and each said guiding portion is for a head portion of the T-shaped staple of the staple unit to be slidably engaged and positioned along the moving path.

6. The magazine assembly of claim 5, wherein the first rail further has a second side wall facing the second rail, the second side wall has at least one rib portion which extends along the moving path, the at least one rib portion respectively corresponds to the at least one guiding portion, the at least one rib portion protrudes toward the second rail, and the at least one rib portion is for abutting laterally against the U-shaped staple of the staple unit.

7. The magazine assembly of claim 3, wherein the first rail further has a top portion and a bottom portion which are connected to the first and second side walls, the bottom portion is connected to the seat body, the top portion has an inclined surface, the inclined surface tilts from the second side wall toward the first side wall and the seat body, and the inclined face is for the head portion of the T-shaped staple to optionally abut thereagainst.

8. The magazine assembly of claim 7, wherein as viewed along the moving path, the staple-pushing member is substantially E-shaped and sandwiched by the first and second rails; the first rail is slab-shaped, the second rail is substantially U-shaped and defines a receiving space with the seat body, and the constant force spring is received in the receiving space; a width of the constant force spring is substantially equal to a distance between two inner walls of the second rail; as viewed along the assembling direction, a first side portion of the constant force spring is remote from the seat body, a second side portion of the constant force spring is close to the seat body, the free end is connected to and positioned on the first end portion from the first side portion toward the second side portion; the first end portion has a hook portion, the constant force spring has a through hole on the free end, and the hook portion is disposed through the through hole to make the free end positioned on the seat body.

9. A stapler, including the magazine assembly of claim 1, further including:

a machine body assembly, including a pressing member, a shell body and a striking plate, the shell body having a magazine area which receives the magazine assembly, the magazine assembly and the shell body defining a staple outlet therebetween, the staple outlet for corresponding to a part of the staple of the staple unit, the pressing member and the striking plate being linked up, when the pressing member is operated from outside and moves relative to the shell body, the striking plate is driven to move toward an opening of the staple outlet and further strike a part of the staple of the staple unit.

* * * * *